US006886685B2

(12) United States Patent
Slater

(10) Patent No.: US 6,886,685 B2
(45) Date of Patent: May 3, 2005

(54) STATIONERY ARTICLE FOR CARRYING SELF-STICK NOTE PADS

(76) Inventor: Robert Slater, 375 Cherrylane, Mendham, NJ (US) 07945

( * ) Notice: Subject to any disclaimer, the term of this patent is extended or adjusted under 35 U.S.C. 154(b) by 132 days.

(21) Appl. No.: 10/197,664

(22) Filed: Jul. 16, 2002

(65) Prior Publication Data

US 2004/0011676 A1 Jan. 22, 2004

(51) Int. Cl.[7] ..... B65D 85/00

(52) U.S. Cl. ..... 206/215; 206/447; 206/450; 206/460

(58) Field of Search ..... 206/387.13, 214, 206/215, 224, 371, 447, 449, 450, 460, 472, 473; 281/31; 150/143

(56) References Cited

U.S. PATENT DOCUMENTS 1,014,581 A * 1/1912 Ehmling ..... 206/215
1,561,343 A * 11/1925 Michaels ..... 150/142
3,829,995 A * 8/1974 Fakoury ..... 40/649
3,870,223 A * 3/1975 Wyant ..... 229/72
4,716,948 A * 1/1988 Brissette ..... 150/132
4,928,814 A * 5/1990 Rondot et al. ..... 206/215
5,036,973 A * 8/1991 Aida ..... 206/214
5,294,208 A * 3/1994 Tremmel et al. ..... 402/70
5,755,340 A * 5/1998 Weingartner ..... 211/50
5,881,850 A * 3/1999 Murdoch ..... 190/110
5,992,620 A * 11/1999 Holtom ..... 206/232

OTHER PUBLICATIONS

Copy of a web page from www.bulgingbriefcase.com containing information on their product Leather Post It Note Holder.
Copy of a web page from www.bulgingbriefcase.com containing information on their product "Things To Do" Note Jotter.
Copy of a web page from www.bulgingbriefcase.com containing information on their product Note Jotter Organizer.
Copy of a web page from www.bulgingbriefcase.com containing information on their product Deluxe Note Jotter Organizer.

* cited by examiner

*Primary Examiner*—Jim Foster
(74) *Attorney, Agent, or Firm*—Jones Day

(57) ABSTRACT

A stationery article of manufacture for carrying one or more self-stick note pads in combination with one or more other items, such as, business cards, photo identification cards, credit cards, check books, calculators, personal digital assistants, a wireless e-mail reader, and other similar items for convenience.

16 Claims, 8 Drawing Sheets

STATIONERY ARTICLE FOR CARRYING SELF-STICK NOTE PADS

BACKGROUND OF THE INVENTION

This invention relates to a stationery article of manufacture for carrying one or more self-stick note pads in combination with one or more other items, such as, business cards, photo identification cards, credit cards, check books, calculators, personal digital assistants, a wireless e-mail reader, etc. for convenience.

SUMMARY OF THE INVENTION

The present invention relates to a stationery article for carrying one or more self-stick note pads in combination with one or more of other items, such as business cards, checkbooks, calculators, credit cards, etc. The stationery article of the present invention, thus, provides the users with the convenience of having self-stick note pads readily available along with one or more of other items that the users normally carry. So, the present invention provides the convenience of having the self-stick note pads available without necessarily increasing the number of items the user must carry. This is a significant benefit in today's society where many people are encumbered with having to carry around numerous other personal and business related items, such as, a mobile telephone, a pager, a personal digital assistant, a wireless e-mail reader, etc.

A stationery article according to a preferred embodiment of the present invention has a substantially flat rectangular body having an inside surface and an outside surface. The substantially flat rectangular body can be folded along a central axis dividing the body into two halves of substantially equal size, so that the inside surfaces of the two halves face each other. One of the two substantially equal sized halves is adapted and configured so that its inside surface can receive at least one self-stick note pad. The other of the two halves is adapted and configured to hold at least one other items, such as, credit-card like items, business cards, check books, calculators, personal digital assistants, wireless e-mail reader, and other similar items on its inside surface. The particular number of self-stick note pads and the other items that can be held by the stationery article of the present invention is a matter of design choice and will depend on the size of the stationery article as well as the sizes of the particular self-stick note pads and the other items intended to be carried by the stationery article.

BRIEF DESCRIPTION OF THE DRAWINGS

For a better understanding of the invention, reference should be made to the following detailed description taken in conjunction with the accompanying drawings, in which.

DETAILED DESCRIPTION OF THE INVENTION

Figure 1:
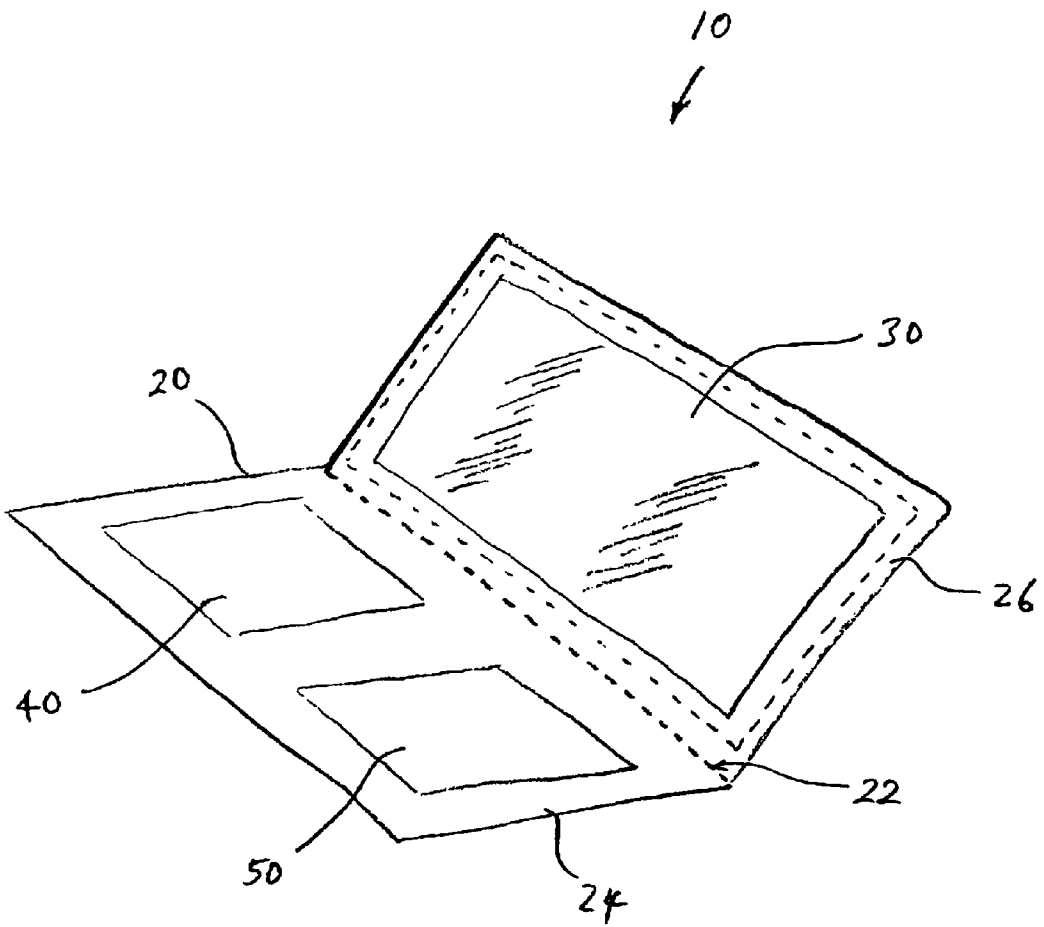
FIG. 1 is a perspective view of a preferred embodiment of a stationery article according to the present invention.

FIG. 1 illustrates a stationery article 10 according to a preferred embodiment of the present invention. The stationery article 10 has a substantially flat and rectangular body 20. The body 20 may be folded along a fold line 22, similar to a wallet or a billfold, defining the body 20 into two halves, a first half 24 and a second half 26. Thus, one side of the flat substantially rectangular body 20 of the stationery article 10 forms inside surfaces of the two halves that face each other when the body 20 is folded. The other side of the substantially flat and rectangular body 20 of the stationery article 10 forms outside surfaces of the two halves that face away from each other when the body 20 is folded.

The first half 24 of the stationery article 10 illustrated here is provided with two self-stick note pad attachment sites 40 and 50. The second half 26 is provided with a card holder site 30 for holding one or more items, such as, business cards, photo identification cards, credit cards, check books, calculators, etc. The stationery article 10 can be made in any variety of sizes depending on the particular sizes and numbers of the self-stick note pads and the other items to be carried in the stationery article 10. In the illustrated example, the card holder site 30 is sufficiently large to hold one or more standard size (3.5 inches×2 inches) business cards arranged in a stack. The self-stick note pad attachment sites 40 and 50 are sufficiently large to receive self-stick note pads whose dimensions are about 2.0 inches×1.5 inches.

The substantially flat and rectangular body 20 of the stationery article 10 can be made of leather, vinyl, or other materials which may be similar to many wallets, billfolds, and check books. The stationery article 10 of the present invention may also be made from other appropriate materials such as fabrics, or other synthetic materials.

Although the stationery article 10 is illustrated as having a substantially flat and rectangular body, the overall shape of a stationery article according to the present invention is not limited to such a shape. The particular shape of a stationery article is a matter of design choice. For example, a stationery article of the present invention can be made in the outline of an animal, a cartoon character, a baseball, a football, fruits, etc.

Figure 2:
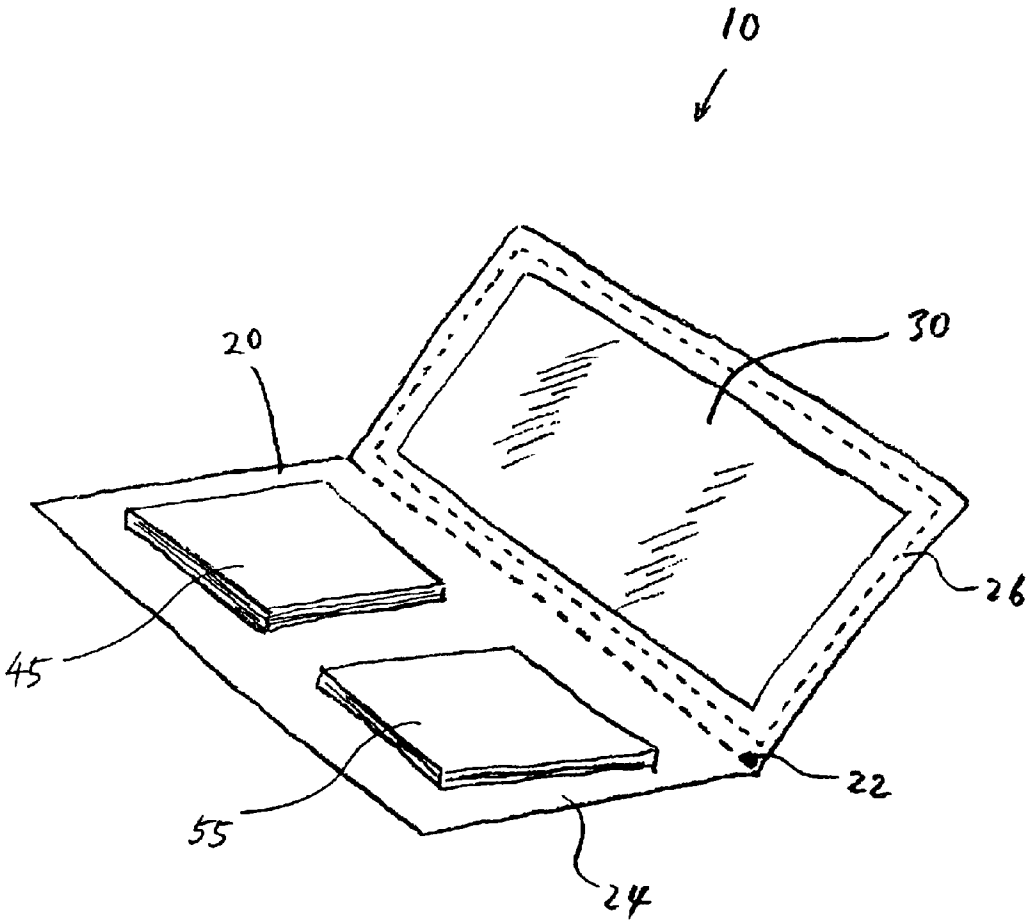
FIG. 2 is a perspective view of the stationery article of FIG. 1 with self-stick note pads attached.

The self-stick note pads can be attached to their corresponding attachment sites 40, 50 by a number of methods. In a preferred embodiment, the backing sheets are removed from the self-stick note pads exposing the adhesive on the last pages of the self-stick note pads. The self-stick note pads are, then, secured to their corresponding attachment sites 40, 50 by the exposed adhesive on the last pages. In this embodiment, the self-stick note pad attachment sites 40, 50 may be a flat surface as illustrated in FIG. 1. FIG. 2 illustrates the stationery article 10 with self-stick note pads 45, 55 secured to each of the self-stick note pad attachment sites 40, 50, respectively. When all the sheets of a self-stick note pad are exhausted, a new self-stick note pad is simply attached to the same site.

Figure 3:
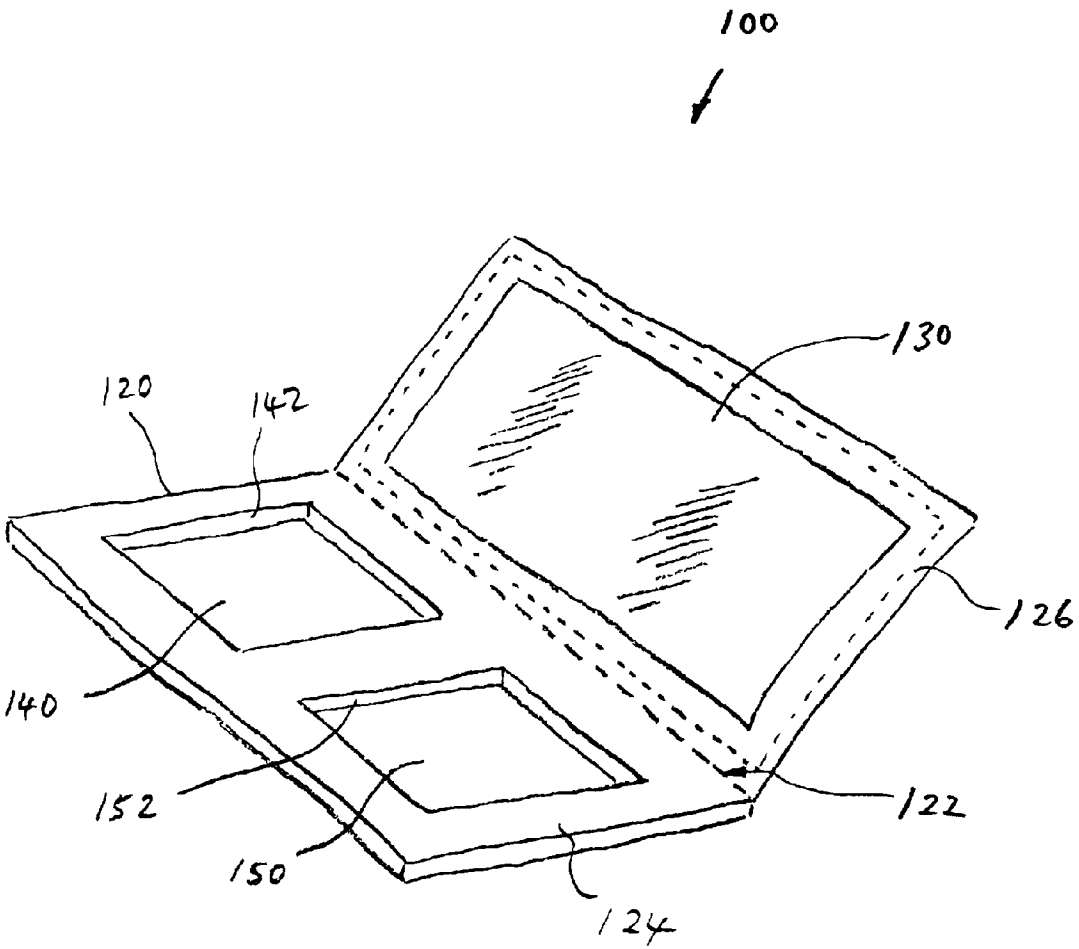
FIG. 3 is a perspective view of another embodiment of the stationery article according to the present invention.
Figure 4:
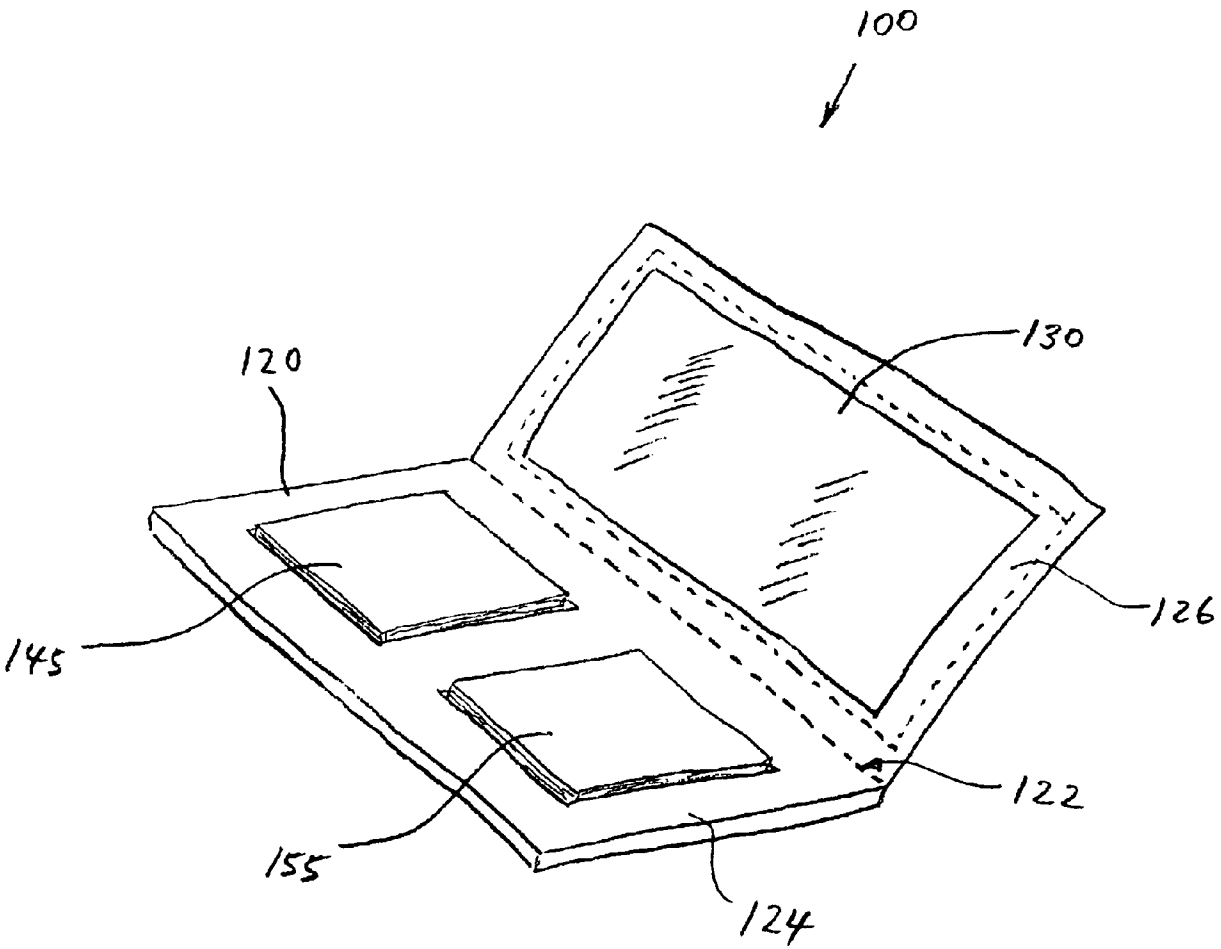
FIG. 4 is a perspective view of the stationery article of FIG. 3 with self-stick note pads attached.

FIG. 3 illustrates a more preferable embodiment of the present invention. A stationery article 100 having a substantially rectangular body 120 foldable along a fold line 122 is provided with self-stick note pad attachment sites 140, 150 on the inside surface of its first side 124. In this embodiment, the self-stick note pad attachment sites 140, 150 are recesses formed into the inside surface of the first side 124. Each of the recessed self-stick note pad attachment sites 140, 150 have four side walls 142, 152, respectively. The sidewalls 142, 152 of the recesses provide a measure of protection for the self-stick note pads so that they are not easily dislodged from their attachment sites 140, 150. FIG. 4 illustrates the stationery article 100 with self-stick note pads 145, 155 secured to the recessed attachment sites 140, 150, respectively.

As in the stationery article 10 illustrated in FIGS. 1 and 2, the particular size of the self-stick note pad attachment sites 140, 150 are determined by the size of the self-stick note pads intended to be secured to those sites. The self-stick note pads can be secured to the corresponding attachment site using the method described in reference to FIG. 1, however, in this embodiment, the self-stick note pads are secured within the recesses.

In this embodiment, either the whole first side 124 of the body 120 or at least the inside surface of the first side 124 may be made from a moldable polymer of appropriate stiffness so that the recesses can be molded into the first side 124. Where the body 120 of the stationery article 110 is made of leather, the recesses may be formed by embossing the leather. However, according to the present invention, the embossed recesses preferably are sufficiently deep to form sufficiently high side walls providing a measure of protection for the self-stick note pads secured within the recesses. Preferably, the recesses are at least 1.0 mm deep. Alternatively, the first side 124 of this leather embodiment of the stationery article may be formed by laminating multiple layers of leather. Then the recesses can be cut into the laminated stacks of leather forming recessed self-stick note pad attachment sites having sufficiently high side walls.

Figure 5:
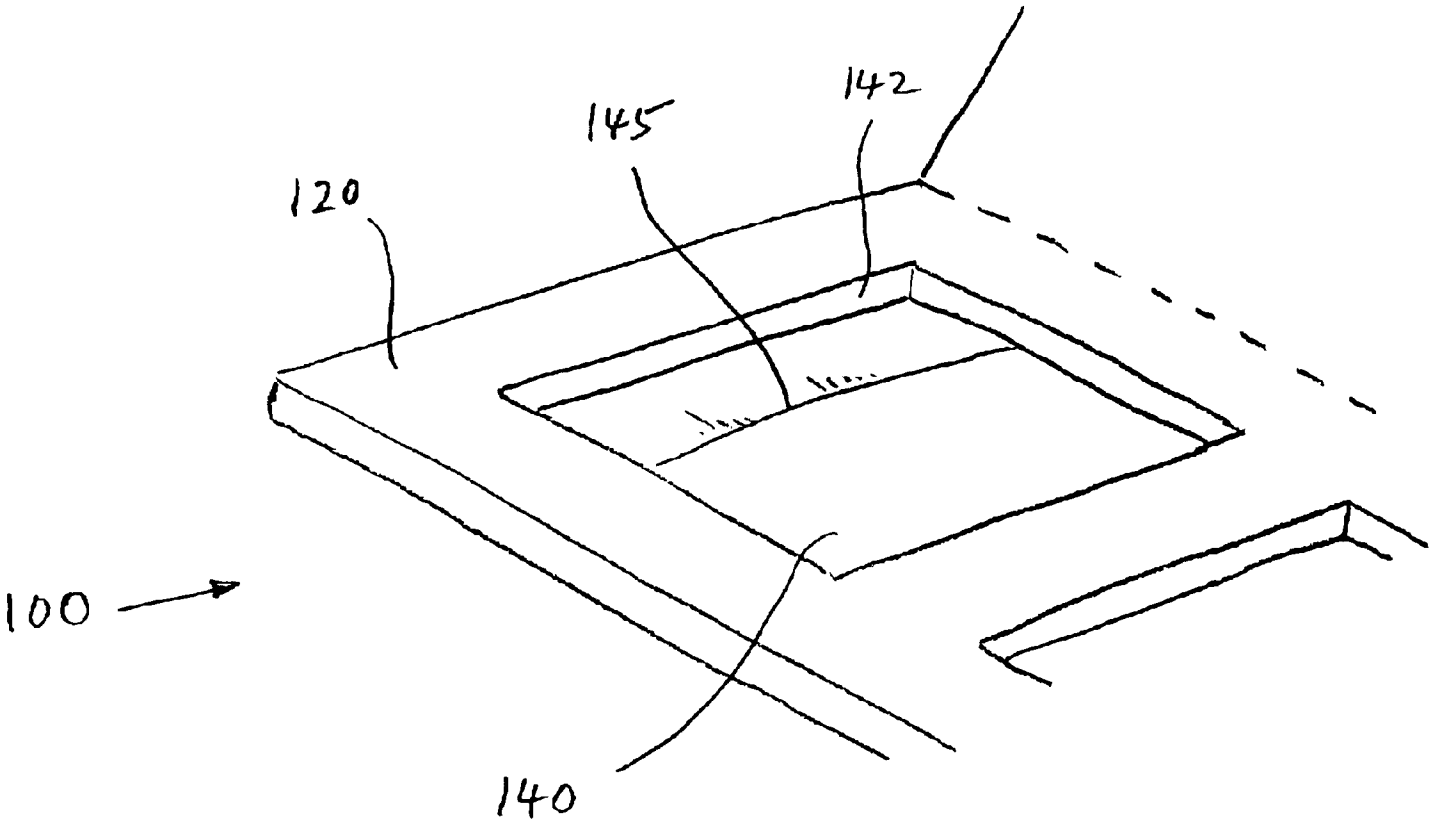
FIG. 5 is a detailed view of a self-stick note pad attachment site of the stationery article of FIG. 3.

The self-stick note pads may be secured to the attachment sites by other alternative means. For example, as illustrated in FIG. 5, a self-stick note pad attachment site 140 can be provided with a pocket having a slit opening 145 into which the backing sheet and/or the last few sheets of the self-stick note pad can be inserted to secure the note pad. This method is similar to the way in which check books are secured in many check book holders. Many check book holders are also provided with a pocket into which the backing sheet of a check book is inserted to secure the check book on to the check book holder.

The examples of stationery articles 10 and 100, illustrated in FIGS. 1–4, have second sides 26, 126 that are adapted and configured to hold and carry one or more items other than self-stick note pads. Such other items can be credit card-like items, such as, credit cards, bank cards, debit cards, photo identification cards, etc. that have similar physical dimensions as most credit cards.

Some more examples of the other items that can be held and carried by the second half of the stationery articles according to the present invention include business cards, check books, calculators, personal digital assistants, and wireless e-mail readers, and other similar items. The list of such other items that can be carried by the stationery article of the present invention should not be limited to the particular items that are enumerated here. The list of items provided here is not meant to be exhaustive but meant to provide the concept that the stationery article of the present invention is intended to provide its user the ability to carry one or more self-stick note pads in combination with one of a numerous other items that the user is likely to carry around in his/her daily life whether it be for personal use or for business reasons. The benefit to the user provided by the stationery article of the present invention is the convenience of having the self-stick note pads readily available in proximity to the other items that the user would normally be carrying already.

In FIGS. 1–4, the second sides 26, 126 of the stationery articles 10, 100 are provided with windowed pockets 30, 130, respectively. These windowed pockets are similar to the photo identification pockets found in many wallets, in which one or more business cards, photo identification cards, credit cards, etc. can be placed and be visible.

Figure 6A:
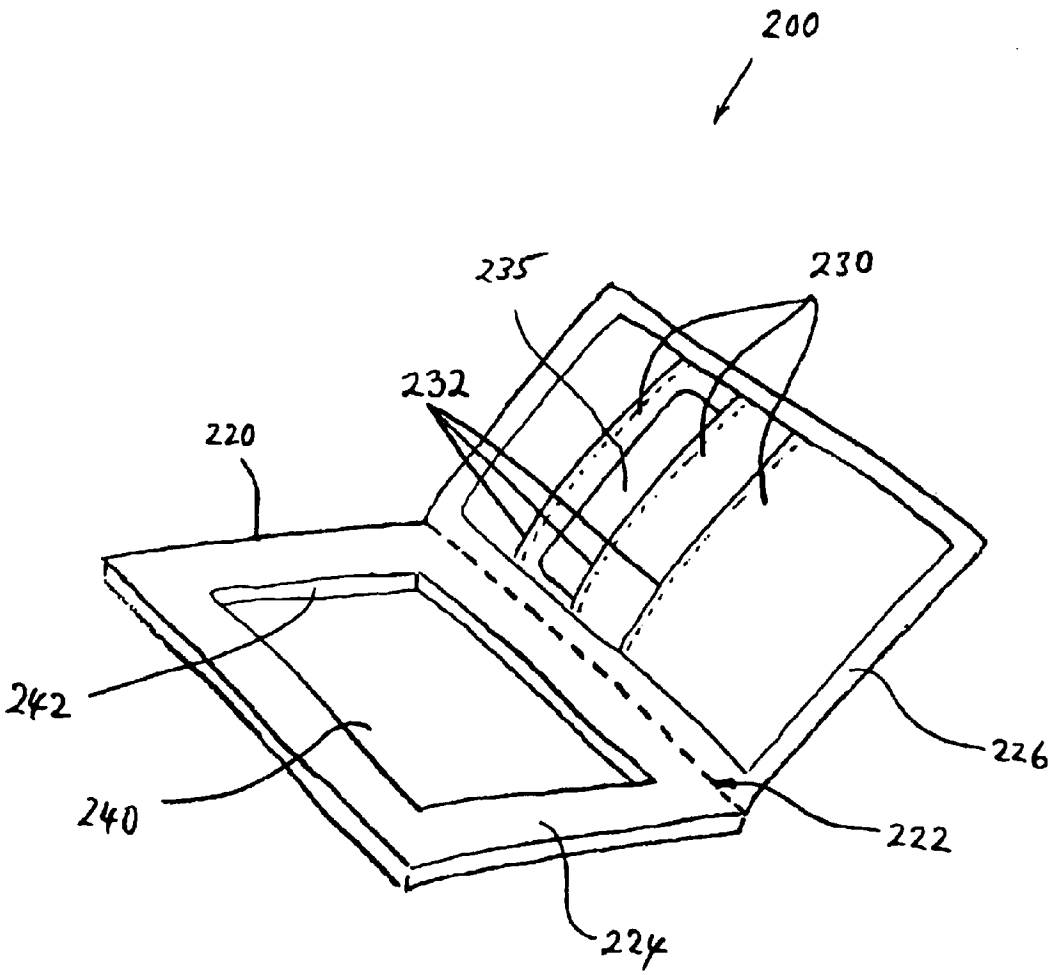
FIG. 6*a* is a perspective view of another embodiment of a stationery article according to the present invention.

In another embodiment illustrated in FIG. 6*a*, a stationery article 200 is provided with a recessed self-stick note pad attachment site 240 on its first side 224. Second side 226 of the stationery article 200 is provided with one or more pockets 230, each having a slit opening 232 for holding one or more other items, such as, credit card-like items, business cards, etc. In the illustrated example, a credit card 235 is inserted into one of the pockets 230. As with the number of self-stick note pad attachment sites, the particular number of pockets 230 provided in the stationery article 200 is a matter of design choice determined by the particular number of items to be carried by the stationery article.

Figure 6B:
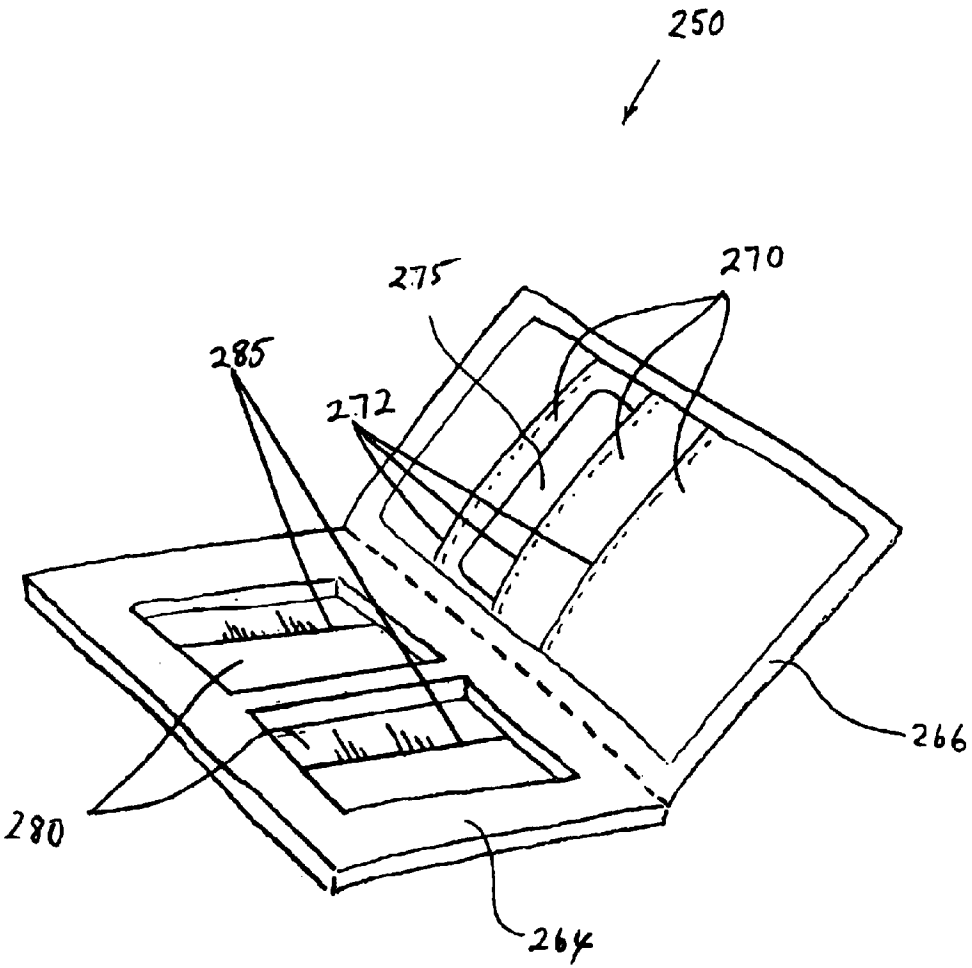
FIG. 6*b* is a perspective view of another embodiment of a stationery article according to the present invention.

In another embodiment illustrated in FIG. 6*b*, a stationery article 250 is provided with two recessed self-stick note pad attachment sites 280 on its first side 264. Second side 266 of the stationery article 250 is provided with one or more pockets 270, each having a slit opening 232 for holding one or more other items, such as, credit card-like items, business cards, etc. In the illustrated example, a credit card 275 is inserted into one of the sockets 270. As with the number of self-stick note pad attachment sites, the particular number of pockets 270 provided in the stationery article 250 is a matter of design choice determined by the particular number of items to be carried by the stationery article.

Furthermore, according to the present invention, the second sides 26, 126, 226, of the stationery articles 10, 100, 200, 250, 266 respectively, can be adapted and configured to hold such bulkier items as a check book, a calculator, a personal digital assistant, or a wireless e-mail reader, etc. These items are typically bulkier than business cards or credit cards, and in order to accommodate these items, the second sides 26, 126, 226, 266 of the stationery articles 10, 100, 200, 250, can be provided with sufficiently large pockets or recessed pockets, and further assisted by appropriate fastening devices, such as, elastic straps, Velcro® straps, or clips. In embodiments where the second side of the stationery article is provided with one or more recessed pockets, the whole second side or at least the inside surface of the second side may be made from a moldable polymer to form the recessed pockets. The recessed pockets should be sufficiently deep to carry the particular item to be held in the pocket.

As mentioned above, stationery articles of the present invention can be made from many different materials. For example, the body of the stationery article can be made from any one of a variety of thermoplastic polymers. Because they are typically more rigid than leather, vinyl, or fabric, thermoplastic polymers can be utilized for embodiments of the present invention where a more rigid body is desired for the stationery article. Rather than the wallet-like embodiments illustrated in FIGS. 1–6*b*, a stationery article having a more three dimensional quality can be constructed using thermoplastic polymers. For example, the stationery article can be molded into a shape of a hockey puck, a football, etc.

Figure 7:
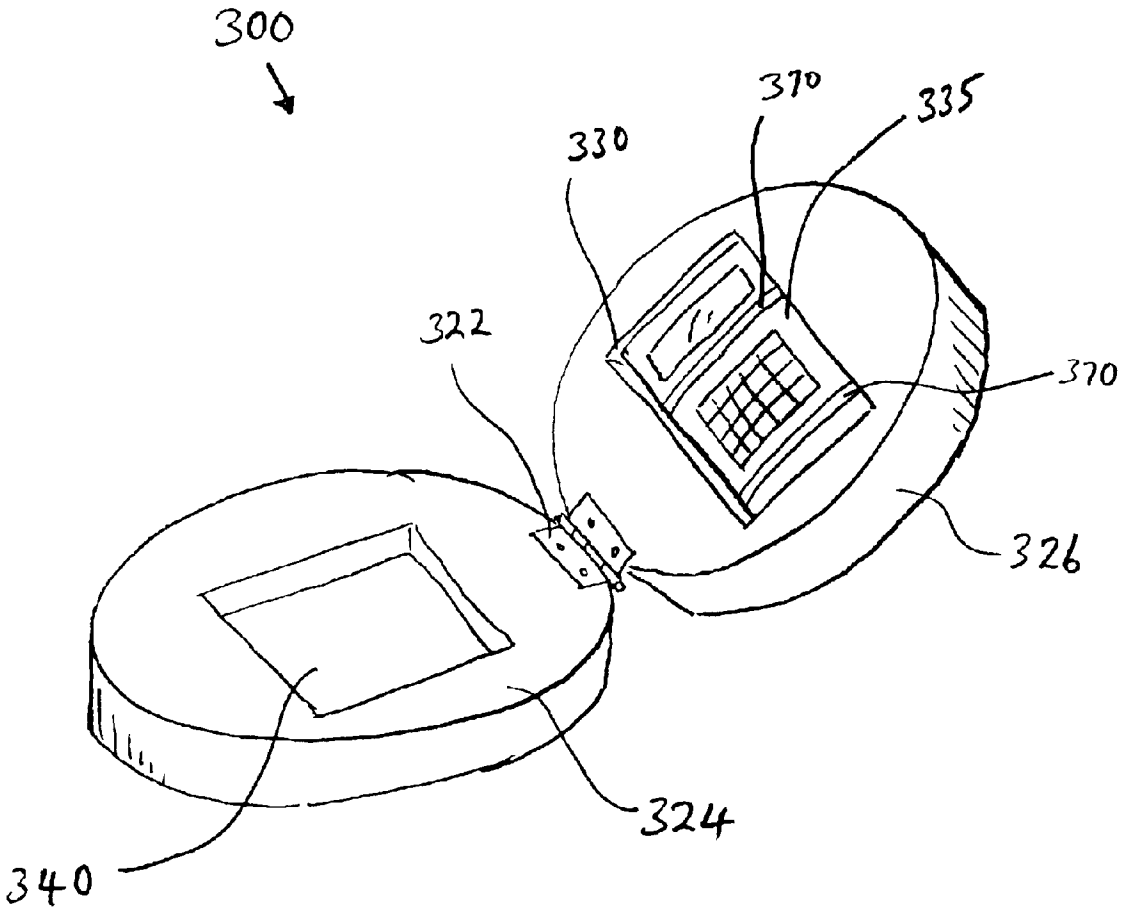
FIG. 7 is a perspective view of another embodiment of a stationery article according to the present invention.

FIG. 7 illustrates the hockey puck embodiment 300 of the present invention. The two halves of the stationery article's body 324, 326, each representing a face of the puck, can be molded as separate pieces and then joined together with a hinge 322 so that the stationery article can be closed and opened as discussed in reference to the embodiments illustrated in FIGS. 1–6*b*. A recessed self-stick note pad attachment site 340 is provided on first half 324 and a recessed pocket 330 is provided on second half 326 for holding items other than self-stick note pads. In this illustrated example, a calculator 335 is held in the recessed pocket 330. Elastic straps 370 are provided to secure the calculator 335 in the recessed pocket 330. A separate hinge 322 is used to hingedly join the two halves of the stationery article 300. But to simplify the assembly operation, in a preferred embodiment, hinge structures can be integrally molded into the two halves and snap fitted together. Such hinge structures are well known in the molded plastics industry and need not be discussed in detail here.

The stationery article according to the present invention can also be provided with at least one fastener for joining the two halves of the body together after the body is folded in half to prevent unwanted opening of the two halves. Examples of fasteners appropriate for this application are fastening straps or tabs fitted with Velcro® or snap buttons. For the stationery articles made of fabrics or leather, zippers can be used to fasten the two halves together.

It will be appreciated to one skilled in the art that the illustrative discussions above are not intended to be exhaustive or to limit the invention to the precise embodiments disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. A stationery article comprising:

a body having a fold with which said body is foldable in half, defining the body into a first half and a second half;

multiple self-stick note pads having a length, width, and thickness secured to the first half;

multiple items other than self-stick note pads carried by the second half of the body;

wherein the first half of the body has multiple recesses, each having a length, width, and a plurality of internal sidewalls sized to receive one of said self-stick note pads;

wherein each said recess has a length at least as long as the length of a respective one of said self-stick note pads, and a width at least as wide as the width of the respective one of said self-stick note pads; and wherein the second half of the body has multiple pockets each having a slit opening in which the items other than self-stick note pads are carried.

2. A stationery article of claim 1, wherein the multiple recesses are each at least 1.0 mm deep.

3. A stationery article of claim 1, wherein the first half of the body has at least one pocket having a slit opening within which at least one self-stick note pad is secured.

4. A stationery article of claim 1, wherein the first half of the body has at least one substantially flat surface onto which said multiple self-stick note pads are secured.

5. A stationery article of claim 1, wherein the multiple items other than self-stick note pads carried by the second half of the body are selected from the group consisting of credit card-like items, business cards, check books, calculators, personal digital assistants, and wireless e-mail readers.

6. A stationery article of claim 1, further comprising:

at least one fastener for joining the two halves of the body together after the body is folded in half.

7. A stationery article of claim 6, wherein the fastener comprises zippers.

8. A stationery article of claim 6, wherein the fastener comprises a strap.

9. A stationery article comprising:

a substantially flat body having a fold with which said body is foldable in half, dividing the body into a first half and a second half, each half having an inside surface and an outside surface;

multiple self-stick note pads having a length, width, and thickness secured to the first half;

wherein the first half of the body has multiple recesses, each having a length, width, and a plurality of internal sidewalls sized to receive one of said self-stick note pads;

wherein each said recess has a length at least as long as the length of a respective one of said self-stick note pads, and a width at least as wide as the width of the respective one of said self-stick note pads; and wherein the second half of the body has at least one windowed pocket on its inside surface in which multiple items other than self-stick note pads can be carried.

10. A stationery article of claim 9, wherein the multiple recesses are each at least 1.0 mm deep.

11. A stationery article of claim 9, wherein the multiple items other than self-stick note pads are selected from the group consisting of credit card-like items, business cards, check books, calculators, personal digital assistants, and wireless e-mail readers.

12. A stationery article of claim 9, further comprising:

at least one fastener for joining the two halves of the body together after the body is folded in half.

13. A stationery article of claim 12, wherein the fastener comprises zippers.

14. A stationery article of claim 12, wherein the fastener comprises a strap.

15. A stationery article of claim 1, wherein said multiple recesses each has at least three sidewalls.

16. A stationery article of claim 9, wherein said multiple recesses each has at least three sidewalls.

* * * * *